US007316238B2

(12) United States Patent
Sumner

(10) Patent No.: US 7,316,238 B2
(45) Date of Patent: Jan. 8, 2008

(54) TENT WITH A REPOSITIONABLE FLOOR

(75) Inventor: Bobby G. Sumner, Atlanta, GA (US)

(73) Assignee: Wingroup North America, Inc., Norcross, GA (US)

( * ) Notice: Subject to any disclaimer, the term of this patent is extended or adjusted under 35 U.S.C. 154(b) by 257 days.

(21) Appl. No.: 11/063,342

(22) Filed: Feb. 22, 2005

(65) Prior Publication Data

US 2005/0189010 A1 Sep. 1, 2005

Related U.S. Application Data

(60) Provisional application No. 60/547,022, filed on Feb. 23, 2004.

(51) Int. Cl.
*E04H 15/56* (2006.01)

(52) U.S. Cl. ..... 135/137; 135/97; 135/116; 135/117

(58) Field of Classification Search ..... 135/87, 135/95–97, 137–138, 115–119
See application file for complete search history.

(56) References Cited

U.S. PATENT DOCUMENTS 2,010,472 A * 8/1935 Angel ..... 135/157
2,036,033 A * 3/1936 Fisher ..... 135/133
2,134,879 A * 11/1938 Levy ..... 135/87
2,266,853 A * 12/1941 Dabney ..... 135/126
2,830,606 A * 4/1958 Daugherty ..... 52/2.19
3,699,986 A * 10/1972 Kirkham ..... 135/97
3,759,277 A * 9/1973 Glade ..... 135/95
4,072,158 A * 2/1978 O'Brien et al. ..... 135/116
4,862,906 A * 9/1989 Jordon ..... 135/95
5,088,740 A * 2/1992 Peterson ..... 273/410
D327,524 S * 6/1992 Kim ..... D21/834
6,848,460 B2 * 2/2005 Zheng ..... 135/126

OTHER PUBLICATIONS

Swiss Gear Zinne Backyard; Tents Etc.—Camping Tents and More; www.store.tentsetc.com/squaredome.html; Date unknown; 5 pages.
Moosejaw Mountaineering and Backcountry Travel, Inc.; Marmot Lair 8 Person Tent (Spring 2007); www.moosejaw.com/moosejaw/product.asp?_id=0&dept_id=10137&pf_id=10007739 &ad_id=googlebase; Date unknown; 3 pages; Madison Heights, MI.
WWW.NEW.COZY.COM; 6 Person Tent Backyard Bar B Q Cover 15' × 10'; www.cig.ebay.com/6-person-tent-backyard-bar-b-q-cover-15-x-10_W0QQitemZ280119708176QQcmdZViewlt . . . ; Date unknown; 7 pages.
WWW.UNDERBID.INC.; Wenzel Camping 36326 Shower Tent; www.underbid.com/action/display/item/15052-1064577879/sku/TPBD1124.html; Date unknown; 2 pages.
The Masked Merchant; Black Pine Sports Four Pines Tent; www.themaskedmerchant.com/store/product.aspx?prdld=170701; Date unknown; 2 pages.

* cited by examiner

*Primary Examiner*—Winnie Yip
(74) *Attorney, Agent, or Firm*—Gardner Groff Greenwald & Villaneuva, PC

(57) ABSTRACT

A tent having a repositionable floor, the floor preferably including a pair of subpanels that mate together and form a water-resistant seam. The subpanels can be repositioned within the interior of the tent or exteriorly of the tent. Additionally, each floor subpanel can be retracted and secured to a wall of the tent so as to create a floorless or partially floorless tent.

18 Claims, 2 Drawing Sheets

TENT WITH A REPOSITIONABLE FLOOR

CROSS-REFERENCE TO RELATED APPLICATION

This application claims the benefit of U.S. Provisional Patent Application Ser. No. 60/547,022, filed Feb. 23, 2004, which application is incorporated herein by reference in its entirety for all purposes.

TECHNICAL FIELD

The present invention relates generally to tents for camping and shelter, and more particularly to a fabric tent having a retractable floor that can be repositioned under and/or outside of the tent.

BACKGROUND OF THE INVENTION

Fabric tents are used by campers, hikers, hunters and others to provide portable shelter. The tents commonly include a collapsible rigid frame of aluminum or fiberglass poles, and a flexible fabric shell of nylon, canvas or the like, typically including one or more wall panels, a roof and a floor. Access to and from the interior of the tent is typically through a door opening through a wall panel, which can be selectively opened and closed, as by a zipper, snaps, tie cords, or other closure means.

One or more panels of open mesh material are sometimes included in the fabric shell to form windows and/or a screen door, allowing visibility through the tent walls, but preventing insects from entering the tent's interior. A rainfly or flap is often provided to cover the mesh panels, if desired, for privacy or to prevent rain or dust from entering the tent's interior.

In many instances, it would be beneficial for tent users to not have a tent floor. For example, there may be times, such as in inclement weather, when a tent user wishes enclose a picnic table at a park or campsite, or other structure that is on or affixed to the ground, under the tent. In other instances, a person may want to create a portable shelter for washing a vehicle or other object without causing the floor to become wet or hold standing water. In other instances, tent users may wish to store muddy tools or equipment under cover of a tent, without making the tent floor dirty.

Thus it can be seen that needs exist for improvements to tents to provide a mechanism for easily removing or repositioning the floor panel. It is to the provision of an improved tent meeting these and other needs that the present invention is primarily directed.

SUMMARY OF THE INVENTION

In example forms, the present invention is a tent defining an enclosure that is at least partially formed of at least one wall panel of flexible material mounted to a frame. The tent preferably includes at least one repositionable floor panel secured to the wall panel, whereby the floor panel is movable between a first position and a second position.

In another aspect, the present invention is a repositionable floor for a tent. The floor preferably includes first and second panels detachably coupled together at a seam. Each panel is preferably attached along a first edge to a wall panel of the tent, and preferably has a second free edge along the seam.

In still another aspect, the present invention is a tent having at least two walls and a roof, preferably including at least one retractable floor panel. Each retractable floor panel preferably has a first edge secured to one of the wall panels, and a second free edge.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF THE EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
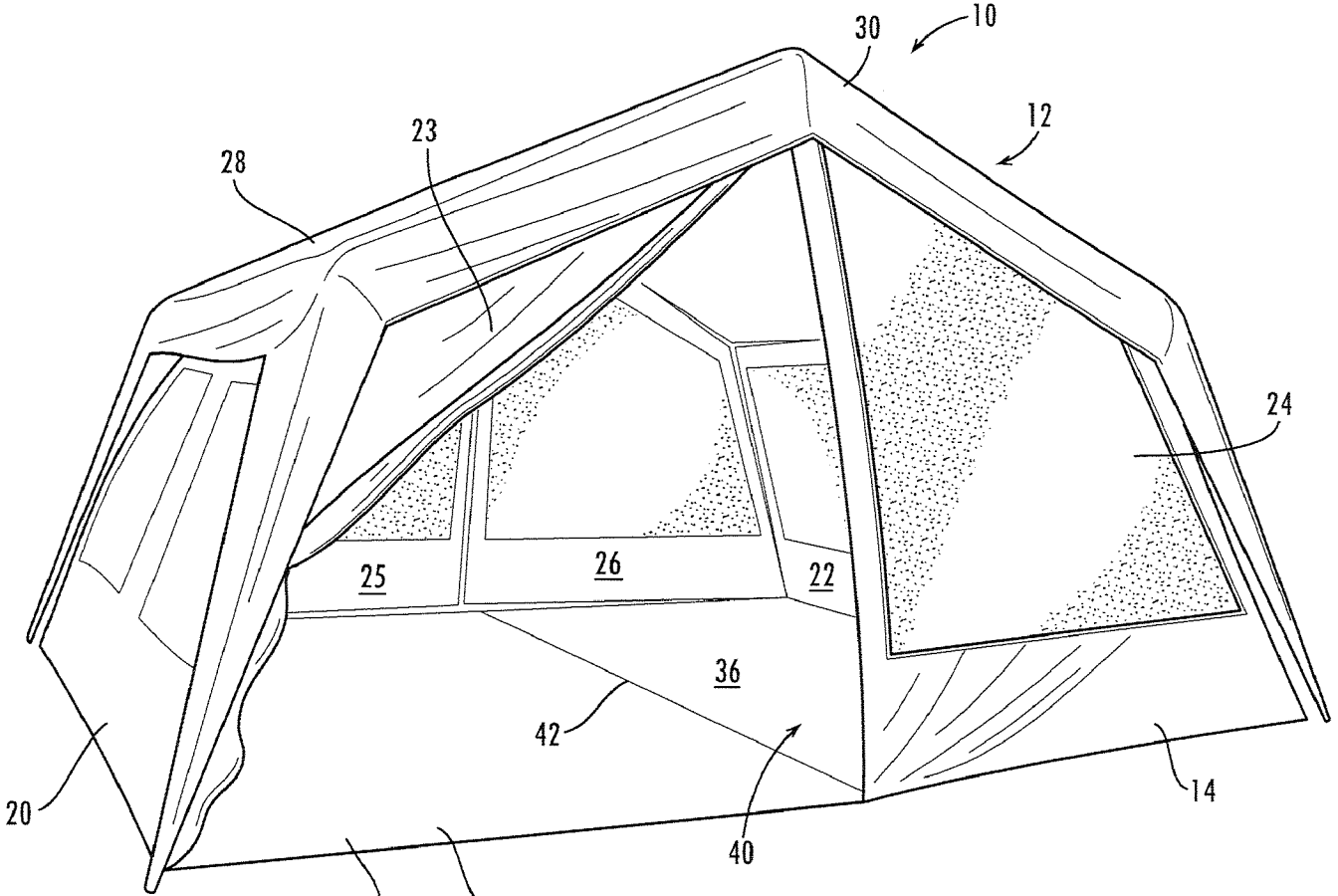
FIG. 1 shows a tent with a repositionable floor according to an example embodiment of the present invention.
Figure 2:
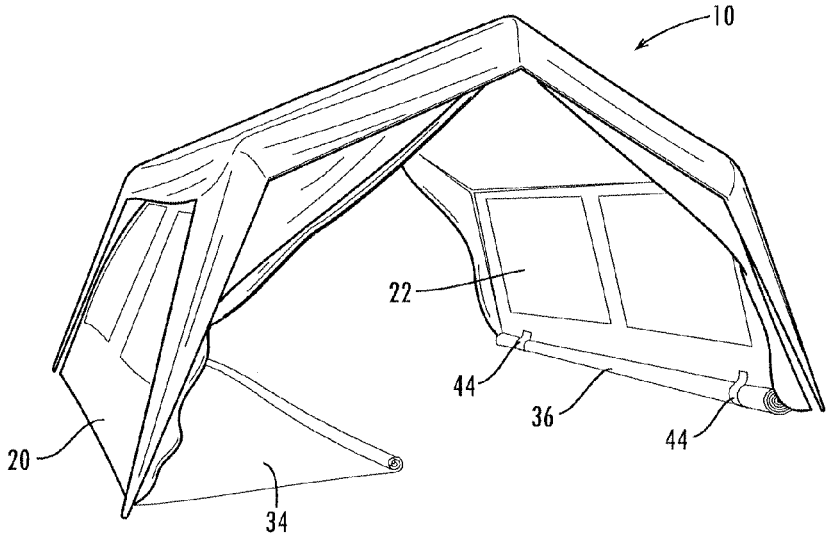
FIG. 2 shows the tent of FIG. 1 with a portion of the floor fully retracted and another portion of the floor partially retracted.
Figure 3:
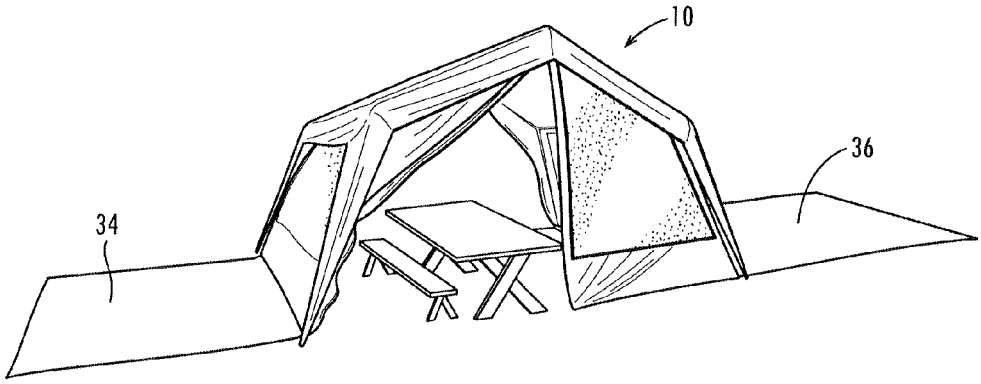
FIG. 3 shows the tent of FIG. 1 with the floor repositioned to the exterior of the tent.

With reference now to the drawing figures, FIGS. 1-3 show a tent 10 according to an example embodiment of the present invention. The tent 10 generally comprises a collapsible rigid frame 12 comprising aluminum or fiberglass poles, for example, and a flexible fabric shell 14 of nylon, canvas, or the like. The tent includes left and right side wall panels 20, 22, one or more front wall panels 23, 24 and one or more rear wall panels 25, 26, one or more roof panels 28, 30 and a floor 32. Access to and from the interior of the tent is preferably provided through a zippered door 40. The wall panels can include one or more windows formed, for example, of see-through mesh fabric panels for visibility and ventilation, and privacy flaps that can be closed to cover the windows.

Preferably, the floor of the tent includes two segments or subpanels 34 and 36. The floor subpanels 34 and 36 are preferably formed of a flexible, yet durable weather-resistant material such as nylon, canvas, vinyl, plastic, or the like. The floor subpanels 34 and 36 can be constructed of the same material as the fabric shell 14, or the floor subpanels 34 and 36 can be constructed of a different material. The floor subpanels 34 and 36 can preferably be joined to one another along a seam 42, for example, by a zipper, hook-and-loop fasteners, snaps, buttons, or the like. Preferably, the attachment at the seam 42 provides a water-resistant seal. The floor subpanels 34 and 36 are optionally removably attached to the left and right side wall panels 20, 22, for example, by a zipper, hook-and-loop fasteners, snaps, buttons, or the like. In various alternative embodiments, the one or more floor subpanel(s) 34 and 36 are an integral extension of the sheet of material that forms the left and right side wall panels 20, 22; or are part of the sheet of material that forms the front wall panels 23, 24 and/or the rear wall panels 25, 26; or are separate sheets of material that are removably attached thereto. Preferably, any removable attachments form water-resistant seams.

FIG. 1 shows the tent 10 with two repositionable floor subpanels 34 and 36, attached together along a seam 42 approximately midway across the floor, and attached to the front wall panels 23, 24 and rear wall panels 25, 26. In this figure, the embodiment is configured for conventional tent use, with a floor upon which sleeping bags and other gear may be layed out.

FIG. 2 shows the tent 10 with one floor subpanel 34 partially rolled up into a compact roll, and the other floor subpanel 36 fully rolled up into a compact roll at the side wall 22 and secured to the wall with fasteners 44. In the depicted embodiment, the fasteners 44 are straps that can be secured to the walls with snaps, buttons, hook and loop fasteners or the like. In alternate forms, the fasteners are snaps, buttons, zippers, tie cords, hook and loop fasteners, or the like. In this configuration, the "roll-a-way" floor design allows campers to enclose a structure or object within a tent, such as a picnic table, that is too heavy or stationary to move.

FIG. 3 shows the tent 10 with its floor subpanels 34, 36 repositioned and extended outwardly to form a ground-covering patio area outside and adjacent to the tent. This provides a dry floor and clean area for lounging and other activities outside of the tent 10, and/or for preventing ground contact with items stored outside the tent. Optionally, the tent 10 can be configured such that the front, rear, and side wall panels are removed, in addition to the floor, to form a floorless and sideless awning.

In alternative embodiments, the floor 32 comprises one repositionable panel or more than two repositionable subpanels. The one or more floor subpanel(s) are optionally of different shapes and sizes, for example having a relative width ratio between two floor subpanels of about 50:50, 60:40, 75:25, etc., to provide various functional advantage. Each of the one or more floor subpanels can optionally be rolled or folded up or otherwise retractable, and/or detachable and removable.

While the invention has been described with reference to preferred and example embodiments, it will be understood by those skilled in the art that a variety of modifications, additions and deletions are within the scope of the invention, as defined by the following claims.

What is claimed is:

1. A tent for assembling on a ground surface, comprising:

at least one wall panel at least partially defining a tent interior; and a floor made of a flexible material and formed by at least one repositionable floor panel having a wall edge extending from the wall panel and having a freeable edge opposite the wall edge, wherein the floor panel is movable between a first position and a second position with the tent assembled for use, in the first position the floor is laid out flat covering all of the ground surface that is within the tent interior with the freeable edge fixed in place, and in the second position the freeable edge is unfixed and the floor panel is retracted into a compact arrangement rolled up to adjacent the wall panel with all or substantially all of the ground surface within the tent interior exposed, and wherein the floor panel is further movable to a third position with the floor panel laid out flat outside of the tent and covering at least a portion of the ground surface that is adjacent the wall panel, with the ground surface covered by the floor panel in the first position now exposed.

2. The tent of claim 1, further comprising at least one fastener, wherein the rolled up floor panel in the second position is secured adjacent the wall panel with the fastener.

3. The tent of claim 1, wherein the at least one wall panel comprises first and second wall panels, and wherein the at least one floor panel comprises first and second floor panels with a closable seam between adjoining freeable edges thereof when the floor panels are extended from the first and second wall panels, respectively, in the first position.

4. The tent of claim 1, wherein the ground surface has an object positioned thereon, and wherein in the second position the tent is assembled with the object positioned within the tent interior.

5. The tent of claim 4, wherein the object is a picnic table.

6. A method of assembling the tent of claim 1, comprising:

(a) locating an object on a ground surface; and (b) assembling the tent over the object with the floor in the second position so that the object is exposed for use and covered by the tent.

7. A method of repositioning the tent floor of the tent of claim 1, comprising:

(a) assembling the tent with the floor in the first position;

(b) unfixing the freeable edge of the floor panel;

(c) retracting the floor panel into the compact arrangement adjacent the wall panel;

(d) securing the floor panel in the retracted compact arrangement; and (e) if the floor is provided with an additional floor panel, then repeating steps (a) through (e) for the additional floor panel, wherein the floor is now in the second position with all of the ground surface that is within the tent interior exposed.

8. A tent for assembling on a ground surface, comprising:

two opposing side wall panels at least partially defining a tent interior; and a floor made of a flexible material and formed by two repositionable floor panels each having a wall edge extending from one of the wall panels and each having a freeable edge opposite the wall edge, wherein the floor panels are movable between a first position and a second position with the tent assembled for use, in the first position the floor panels are laid out flat covering all of the ground surface that is within the tent interior with the freeable edges coupled together to form a seam, and in the second position the freeable edges are decoupled and the floor panels are each retracted into a compact arrangement adjacent the respective wall panels with all or substantially all of the ground surface within the tent interior exposed, and wherein the floor panels are further movable to a third position with each of the floor panels laid out flat outside of the tent on opposite sides of the tent and covering at least a portion of the ground surface that is adjacent the respective wall panels, with the ground surface covered by the floor panels in the first position now exposed.

9. The repositionable floor of claim 8, wherein the seam is water-resistant.

10. The improvement of claim 8, wherein the retractable floor panels are removable from the wall panels.

11. The tent of claim 8, wherein the ground surface has an object positioned thereon, and wherein in the second position the tent is assembled with the object positioned within the tent interior.

12. The tent of claim 8, wherein the floor panels each have opposing front and rear edges extending between the respective wall and freeable edges; and further comprising a front wall panel and a rear wall panel that cooperate with the two side wall panels to define the tent interior, that removably couple to the front and rear edges of the floor panels when the floor is in the first position, and that decouple from therefrom for moving the floor panels to the second position.

13. A method of repositioning the tent floor of the tent of claim 12, comprising:

(a) assembling the tent with the floor panels in the first position;

(b) decoupling the freeable edges of the floor panels from each other;

(c) decoupling the front and rear edges of the floor panels from the front and rear wall panels;

(d) retracting the floor panels into the compact arrangement adjacent the respective wall panels; and (d) securing the floor panels in the retracted compact arrangement, wherein the floor panels are now in the second position with all of the ground surface that is within the tent interior exposed.

14. A tent for assembling on a ground surface, comprising:

at least one wall panel at least partially defining a tent interior; and a floor made of a flexible material and formed by at least one repositionable floor panel having a wall edge extending from the wall panel and having a freeable edge opposite the wall edge, wherein the floor panel is movable between a first position, a second position;and a third position with the tent assembled for use, in the first position the floor is laid out flat covering all of the ground surface that is within the tent interior with the freeable edge fixed in place, in the second position the freeable edge is unfixed and the floor panel is retracted into a compact arrangement adjacent the wall panel with all or substantially all of the ground surface within the tent interior exposed, and in the third position the floor panel is laid out flat outside of the tent and covering at least a portion of the ground surface that is adjacent the wail panel, with the ground surface covered by the floor panel in the first position now exposed.

15. The tent of claim 14, wherein the at least one floor panel comprises first and second floor panels with a closable seam between adjoining freeable edges thereof when the floor panels are in the first position.

16. The tent of claim 14, wherein the ground surface has an object there upon, and wherein in the second position the tent is assembled with the object positioned within the tent interior.

17. The tent of claim 16, wherein in the second position the floor panel is rolled up to adjacent the wall panel.

18. A method of repositioning the tent floor of the tent of claim 14, comprising:

(a) assembling the tent with the floor in the second position;

(b) unsecuring the floor panel from the retracted compact arrangement;

(c) extending the floor panel to outside of the tent and covering at least a portion of the ground surface that is adjacent the wall panel; and (e) if the floor is provided with an additional floor panel, then repeating steps (a) through (e) for the additional floor panel, wherein the floor is now in the second position with all of the ground surface that is within the tent interior exposed.

* * * * *